US008693899B2

(12) United States Patent
Hymas et al.

(10) Patent No.: US 8,693,899 B2
(45) **Date of Patent: *Apr. 8, 2014**

(54) SYSTEM AND METHOD FOR PROVIDING A MESSAGE ON A REPLACEABLE PRINTING COMPONENT

(75) Inventors: Scott K. Hymas, Meridian, ID (US); Richard L. Swantner, Boise, ID (US); Darius Boockholdt, Eagle, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 354 days.

This patent is subject to a terminal disclaimer.

(21) Appl. No.: 13/141,254

(22) PCT Filed: Jan. 30, 2009

(86) PCT No.: PCT/US2009/032613

§ 371 (c)(1), (2), (4) Date: Jun. 21, 2011

(87) PCT Pub. No.: WO2010/087846

PCT Pub. Date: Aug. 5, 2010

(65) Prior Publication Data

US 2011/0279865 A1 Nov. 17, 2011

(51) Int. Cl.
*G03G 15/00* (2006.01)

(52) U.S. Cl.
USPC ..... 399/24; 399/25; 399/26; 399/110

(58) Field of Classification Search
USPC ..... 399/110, 24–26
See application file for complete search history.

(56) References Cited

U.S. PATENT DOCUMENTS

| | | | | |
|---|---|---|---|---|
| 4,771,313 | A | 9/1988 | Kuroda et al. | |
| 5,758,224 | A | 5/1998 | Binder et al. | |
| 6,173,128 | B1 * | 1/2001 | Saber et al. | 399/24 |
| 6,332,062 | B1 * | 12/2001 | Phillips et al. | 399/24 |
| 6,975,422 | B2 | 12/2005 | Kurz et al. | |
| 7,230,730 | B2 | 6/2007 | Owen et al. | |
| 7,258,411 | B2 | 8/2007 | Anderson et al. | |
| 7,620,333 | B2 * | 11/2009 | Swantner et al. | 399/24 |
| 2004/0046033 | A1 | 3/2004 | Kolodziej et al. | |
| 2005/0286070 | A1 | 12/2005 | Kurz et al. | |
| 2006/0021896 | A1 | 2/2006 | Cleathero et al. | |
| 2007/0063013 | A1 | 3/2007 | Marowski et al. | |
| 2009/0080911 | A1 * | 3/2009 | Swantner et al. | 399/24 |

FOREIGN PATENT DOCUMENTS

JP 2005297223 10/2005

OTHER PUBLICATIONS

Copier Superstore, Xerox Phaser 3500N Printer, www.copiersuperstore.com/xerox-3500n.html, 3 pgs., Nov. 26, 2008.
Xerox Corporation, Phaser 3500 black and white printer, Brochure 4 pgs., Copyright 2005.
PCT International Search Report May 29, 2009, (3 pgs.).

* cited by examiner

*Primary Examiner* — Susan Lee

(57) ABSTRACT

A method for providing a message on a replaceable printing component of a printing device includes detecting a trigger event, retrieving a message from a memory associated with the replaceable printing component in response to the trigger event, and forming the message on an imaging member of the replaceable printing component, wherein the trigger event includes an end of a print job, and wherein the message remains on the imaging member after completion of the print job.

15 Claims, 4 Drawing Sheets

SYSTEM AND METHOD FOR PROVIDING A MESSAGE ON A REPLACEABLE PRINTING COMPONENT

BACKGROUND

Many types of printing devices are equipped with replaceable components that have a limited operational life during which the replaceable components are functional. Such replaceable components include toner cartridges, fusers, drums, etc. Occasionally, a user of the printing device believes the replaceable component is not working properly. In such instances, the user may return the replaceable component to the manufacturer, the retailer, or a service center for service or replacement under warranty. While some replaceable components returned under warranty are in fact not working properly and should be replaced or serviced, many returned replaceable components have in fact reached the end of their service life and are no longer covered by warranty.

Unfortunately, it is often difficult for personnel handling product returns to accurately determine whether the replaceable component has in fact reached the end of its service life, and/or whether the replaceable component is still under warranty. Consequently, many replaceable components that have in fact reached the end of their service life and, therefore, are no longer under warranty, are unnecessarily replaced by the manufacturer, retailer, or service center, at significant cost to the manufacturer, retailer, or service center.

DETAILED DESCRIPTION

In the following detailed description, reference is made to the accompanying drawings which form a part hereof, and in which is shown by way of illustration specific embodiments in which the invention may be practiced. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
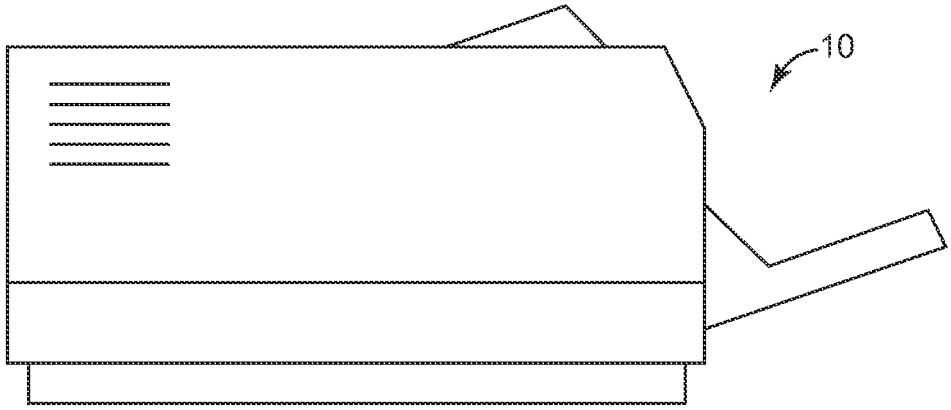
FIG. 1 is a schematic illustration of one embodiment of a printing device.

FIG. 1 is a schematic illustration of one embodiment of a printing device 10 in which embodiments of the present invention may be implemented. For purposes of illustration, the representative printing device 10 is described in the context of laser printers. However, other embodiments of the invention may be implemented in other types of printing devices, such as photocopiers, facsimile machines, and the like.

Figure 2:
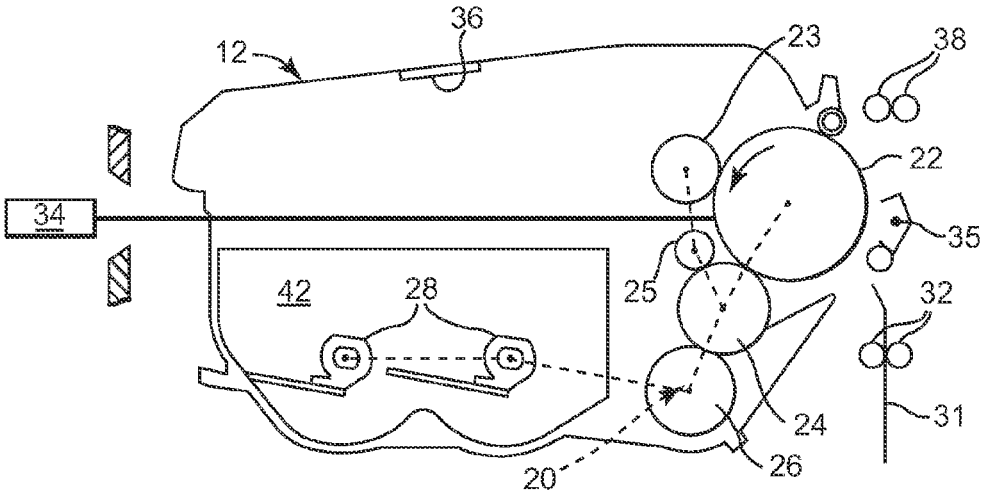
FIG. 2 is a schematic illustration of one embodiment of a replaceable printing component for use in a printing device.

FIG. 2 is a schematic illustration of one embodiment of a replaceable printing component 12 that may be installed in printing device 10. Although replaceable printing component 12 is illustrated and described herein embodied as a printer toner cartridge for a laser printer, it is noted that the replaceable printing component may be embodied as any replaceable printing component (toner cartridge, print drum, etc.) installable in a printing device (printer, copier, fax machine, etc.).

In one embodiment, replaceable printing component 12 includes one or more moveable elements rotatably driven via a gear train 20 during a printing operation. The embodiment of replaceable printing component 12 of FIG. 2 includes a photoconductive (PC) drum 22, a charge roller 23, a developer roller 24, a toner charge roller 25, a toner feed roller 26, and mixing paddles 28. Mixing paddles 28 are positioned within a toner supply reservoir 42 in which powdered toner is contained for delivery to the surface of photoconductive drum 22 via toner feed roller 26 and developer roller 24. In one embodiment, print media, such as a sheet of paper 31, is delivered via a plurality of supply rollers 32 against photoconductor drum 22 where an image is transferred from drum 22 to paper 31.

According to one embodiment of construction, photoconductive drum 22 is an organic photoconductive (OPC) drum. It is understood, however, that other forms of photoconductor drums can be utilized. For example, a photoconductive belt may be used in place of drum 22. It is further understood that other embodiments of replaceable printing component 12 may have other arrangements of rollers, gear trains, toner supply mechanisms, and the like. In addition, replaceable printing component 12 may comprise either a color printing component, or a black printing component.

In one embodiment of operation, printing device 10 performs a complete cycle of image-forming operations with each complete revolution of photoconductive drum 22. Beginning with a process initiation point on drum 22, a charging device, such as charge roller 23, electrostatically charges photoconductive drum 22. Subsequently, an exposure device 34, such as a solid state laser and an imaging optics array, exposes photoconductive drum 22 with an image light pattern. Exposure of photoconductive drum 22 results in selective discharge of the previously uniformly charged area created by charge roller 23, thereby producing an electrostatic latent image on photoconductive drum 22.

In one embodiment, electrostatically charged toner particles (black and/or colored) are delivered by toner feed roller 26 and developer roller 24 to the photoconductive surface of drum 22. Developer roller 24 is electrically biased so as to repel the charged toner onto the latent image produced on photoconductive drum 22. In this manner, toner is transferred onto photoconductive drum 22 so as to form a pattern thereon which duplicates the latent image formed by exposure device 34.

In one embodiment, a charging device 35, such as an electrically biased roller or discharge corona, charges the back side of paper 31 such that toner is transferred from photoconductive drum 22 onto paper 31 in the region of charging device 35 where paper 31 and photoconductive drum 22 contact each other. Subsequently, a fusing station, such as a pair of hot fusing rollers 38, thermally fuses the transferred toner onto paper 31. In some printing devices, an intermediate transfer roller may be used to transfer the toner image from drum 22 to paper 31. Those members of replaceable printing component 12 that receive or transfer a toner image are referred to herein as "imaging members."

In one embodiment, replaceable printing component 12 includes a memory device 36. Memory device 36 may be placed at any location on or within replaceable printing component 12, and may be any type of memory device practical for the purposes described herein. In one embodiment, memory device 36 is a radio frequency identification (RFID) memory device. RFID memory devices and applications therefor are known in the art. Memory device 36 may also be a conventional semiconductor memory and may communicate with printing device 10 via conventional electrical connections. Further aspects of memory device 36 and its functionality are described below.

Figure 3:
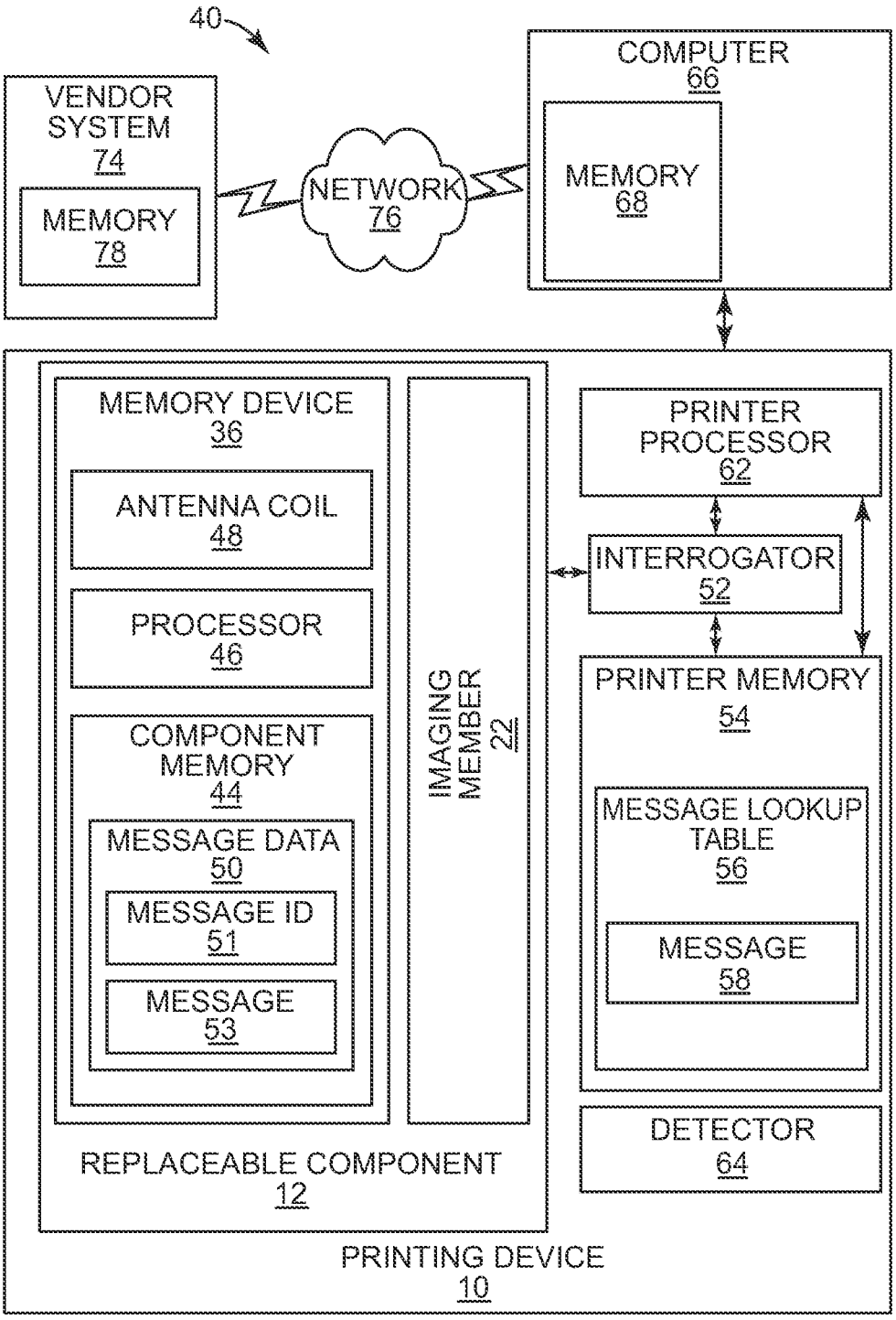
FIG. 3 is a block diagram of one embodiment of a printing system including a printing device with a replaceable printing component.

FIG. 3 is a block diagram of one embodiment of a printing system 40 including printing device 10 which has replaceable printing component 12 installed therein which, in turn, may be removed and replaced by another replaceable printing component. In one embodiment, as described above, replaceable printing component 12 includes memory device 36 and at least one imaging member, such as photoconductive drum 22.

As previously described, in one embodiment, memory device 36 is an RFID memory device. As an RFID memory device, memory device 36 includes component memory 44, a processor 46, and an antenna coil 48. In one embodiment, component memory 44 has message data 50 stored therein. Message data 50 may comprise one or more message identifiers 51 and/or one or more messages 53. Message identifiers 51 may identify which messages 53 are to be used and/or identify a location of a message if the message to be used is located other than in component memory 44. In one embodiment, component memory 44 is of sufficient size to contain the complete electronic representation of messages 53 such that message identifiers 51 may not be needed. The format and function of message data 50 will be described in further detail below.

In one embodiment, memory device 36 is designed to operate in conjunction with an interrogating device, also known as an interrogator. An interrogator is a device that provides power to, reads from, and/or writes to memory device 36. Examples of interrogators include a memory device reader or scanner, and a memory device writing device which stores data on memory device 36. In the described embodiment, printing device 10 includes an interrogator 52.

In one embodiment, interrogator 52 emits a radio frequency field that provides power to memory device 36 via antenna coil 48. In such an embodiment, therefore, memory device 36 does not need a separate power supply, thereby adding to the cost efficiency and practicality of utilizing RFID memory for memory device 36.

In one embodiment, communications between interrogator 52 and memory device 36 are transmitted and received via the radio frequency field and antenna coil 48 utilizing standard RFID methods and protocols, such as those promulgated in ISO 14443 and ISO 15693. Therefore, physical contact between memory device 36 and printing device 10 is not needed for communication between printing device 10 and memory device 36.

In one embodiment, printing device 10 includes printer memory 54. In one embodiment, printer memory 54 contains a message look-up table 56 that contains messages 58. In one embodiment, messages 58 are in addition to messages 53 contained in component memory 44. In one embodiment, as described below, messages 58 correspond to message identifiers 51 of message data 50.

In one embodiment, printing device 10 also includes a printer processor 62 and a detector 64. Detector 64 is located in printing device 10 and is configured to detect the occurrence of one or more trigger events that occur with replaceable printing component 12. In one embodiment, detector 64 is also configured to correlate a message identifier 51 from message data 50 with a message 58 in message look-up table 56 of printer memory 54.

A trigger event may be any predefined event that can be detected by printing device 10. In one embodiment, the trigger event is an end of a print job. More specifically, the end or completion of each print job processed by printing device 10 is considered a trigger event. Thus, as described below, at the end of each print job processed by printing device 10, as one embodiment of the occurrence of a trigger event, message 53 and/or message 58 is formed on an imaging member of replaceable printing component 12.

Additional trigger events include, for example, a change in an operational life status or a warranty status of the replaceable printing component such as near or complete depletion of toner from the replaceable printing component, the number of pages printed utilizing the replaceable printing component (e.g., 1000 pages printed with replaceable printing component 12), the time elapsed since the replaceable printing component was installed (e.g., 90 days after replaceable printing component 12 was installed), the time elapsed since the replaceable printing component was manufactured (e.g., 1 year after replaceable printing component 12 was manufactured). In one embodiment, trigger events are predefined by the manufacturer of the replaceable printing component.

Messages 53,58 may include any message desired to be conveyed to a user and/or service or warranty personnel upon the occurrence of a trigger event. Messages 53,58 may include, for example, a life status message (e.g., "Low Toner," "Out Of Toner"), a warranty status message (e.g., "In Warranty," "Out Of Warranty"), a marketing message (e.g., "Thank You For Purchasing Genuine Hewlett-Packard Products"), a re-order information message (e.g., "Call 555-123-4567 For Replacement Cartridges"), a return message (e.g., "Mail Empty Cartridges To PO Box 123, Anytown, USA"), or any combination of messages thereof ("Toner Level Low—Please Contact Hewlett-Packard At 555-123-4567 To Order A New Toner Cartridge").

In one embodiment, where the trigger event includes the end of each print job, message 53,58 includes a warranty status message such as "In Warranty" or "Out Of Warranty" depending on the warranty status of replaceable printing component 12. Thus, as long as replaceable printing component 12 is within warranty, message 53,58 includes "In Warranty" such that "In Warranty" is formed on an imaging member of replaceable printing component 12, as described below, at the end of each print job processed by printing device 10.

In one embodiment, message 53,58 comprises a two-part message including a primary message and a secondary message such that the secondary message is associated with and/or supports the primary message. In one embodiment, for example, the primary message includes a warranty status message and the secondary message includes a specific reason for the warranty status. In one exemplary embodiment, the warranty status message includes "Out Of Warranty" and the reason includes "Toner" (indicating, e.g., that a Toner Out condition has occurred with the replaceable printing component), "Rotations" (indicating, e.g., that a specified number of drum or developer rotations have occurred with the replaceable printing component), "Environmental" (indicating, e.g., that the replaceable printing component has been used outside of the specified environmental conditions), "Non-HP" (indicating, e.g., that the replaceable printing component is a non-HP or remanufactured component), or "Refill" (indicating, e.g., that the toner sensor of the replaceable printing component reached a low state, and has since received a signal that its toner level is above the low state). The two-part message, therefore, may include "Out Of Warranty-Toner," "Out Of Warranty-Rotations," etc.

In one embodiment, the trigger event also includes the replacement of replaceable printing component 12 in printing device 10. For example, upon replacement of replaceable printing component 12 in printing device 10, printing device 10 determines whether replaceable printing component 12 is an appropriate replacement component for printing device 10. More specifically, in one embodiment, printing device 10 determines whether a manufacturer of replaceable printing component 12 is associated with a manufacturer of printing device 10.

Accordingly, in one embodiment, message 53,58 includes one message if the manufacturer of replaceable printing component 12 is associated with (affiliated with or the same as) the manufacturer of printing device 10, and includes another message if the manufacturer of replaceable printing component 12 is not associated with (not affiliated with or not the same as) the manufacturer of printing device 10. As such, use of a replaceable printing component 12 in printing device 10 from a manufacturer other than the manufacturer of printing device 10 may be identified by message 53,58.

For example, in one embodiment, message 53,58 includes one message if the manufacturer of replaceable printing component 12 is associated with the manufacturer of printing device 10 (e.g., "Genuine HP Product" when replaceable printing component 12 is an HP product and printing device 10 is an HP product), and includes another message if the manufacturer of replaceable printing component 12 is not associated with the manufacturer of printing device 10 (e.g., "Non-HP" when replaceable printing component 12 is not an HP product and printing device 10 is an HP product).

Although message 53,58 has been described in one embodiment as being a phrase (e.g., "Low Toner," "In Warranty," "Out Of Warranty-Rotations"), in another embodiment, message 53,58 may include a unique marking or markings such as an asterisk (*) or a unique character or symbol not commonly found on a standard computer keyboard. For example, message 53,58 may include a company logo or identifying mark (i.e., trademark). In another embodiment, message 53,58 may include a code. For example, a "1" may indicate an In-Warranty status and a "0" may indicate an Out-of-Warranty status. Furthermore, message 53,58 may be any combination of a phrase, unique marking, or code.

In one embodiment, printing device 10 is connected to a computer 66 which includes memory 68. In one embodiment, memory 68 of computer 66 may contain message look-up table 56. In one embodiment, printing device 10, via computer 66, is connected to a vendor system 74 via a network 76, such as the Internet, a local area network (LAN), a wide area network (WAN), or the like. In one embodiment, vendor system 74 includes memory 78, which may contain message look-up table 56. Maintaining look-up table 56 and messages 58 on vendor system 74 allows the vendor to maintain control over the content of messages 58, and allows the vendor to alter messages 58 at any time.

It is noted that although components of printing system 40 are shown in specific locations, components of printing system 40 may be located in printing device 10, replaceable printing component 12, computer 66, vendor system 74, or combination thereof, provided the functionality of printing system 40 is preserved.

Figure 4:
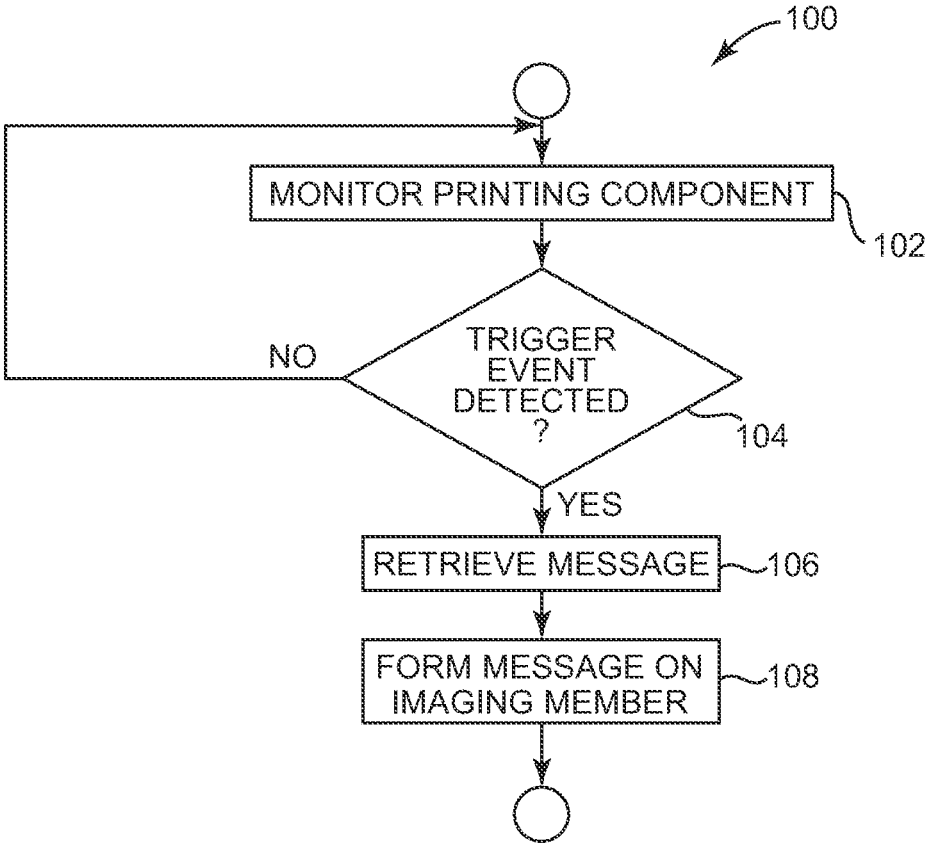
FIG. 4 is a flow diagram illustrating one embodiment of a method of providing a message on a replaceable printing component.

FIG. 4 is a flow diagram illustrating one embodiment of a method 100 of providing message 53,58 on replaceable printing component 12. At 102, detector 64 monitors replaceable printing component 12 for an occurrence of a trigger event. In one embodiment, the trigger event is the end of a print job, as described above. In another embodiment, the trigger event is a change in the operational life status or the warranty status of replaceable printing component 12, as described above. In another embodiment, the trigger event is the replacement of replaceable printing component 12 in printing device 10, also as described above.

As shown at 104, when the trigger event is detected, detector 64 is configured to retrieve message data 50 that corresponds to the trigger event (106). As described above, message data 50 may be one or more message identifiers 51 and/or one or more messages 53. In one embodiment, if message data 50 includes message identifier(s) 51, the corresponding message(s) 58 is retrieved from message look-up table 56 of printer memory 54. If message data 50 includes message(s) 53, message(s) 53 is retrieved from component memory 44, and message look-up table 56 is not utilized. It is noted that if message look-up table 56 is contained in memory 68 of computer 66 connected to printing device 10, the process is similar to that described above, except that printing device 10 communicates with computer 66 to retrieve message(s) 58. Similarly, if message look-up table 56 is contained in memory 78 of vendor system 74, printing device 10 communicates with vendor system 74 to access message(s) 58. After message(s) 53,58 is retrieved, message(s) 53,58 is formed on one or more imaging members of replaceable printing component 12 (108).

In one exemplary embodiment where replaceable printing component 12 comprises a laser printer toner cartridge, exposure device 34 exposes photoconductive drum 22, as one embodiment of an imaging member, to form a latent electrostatic image of message(s) 53,58 on the photoconductive surface of photoconductor drum 22. As such, toner particles are delivered to the photoconductive surface of photoconductor drum 22 so as to develop the image of message(s) 53,58. The developed image of message(s) 53,58, however, is not transferred to the print media (e.g., paper 31). That is, message(s) 53,58 remains on the imaging member such that the developed image of message(s) 53,58 remains on photoconductive drum 22 after completion of the print job.

In one embodiment, message(s) 53,58 is formed on the imaging member of replaceable printing component 12 in an area outside of an application accessible imageable area. More specifically, applications using printing device 10, for example, word processing software such as Microsoft Word, generate images only within an imageable area. The application (or user) accessible area of the imaging member, therefore, is limited to the imageable area of the imaging member. Printing device 10, however, may also produce images on the imaging member outside of the imageable area accessible to the application (or user). By forming message(s) 53,58 outside the application accessible imageable area, users are prohibited from fraudulently producing messages on the imaging member on their own.

In one embodiment, message(s) 53,58 may be visible on the imaging member (e.g., to a user or service or warranty personnel) upon removing replaceable printing component 12 from printing device 10. In another embodiment, message(s) 53,58 is not visible (or at least not readily visible) on the imaging member (e.g., to a user or service or warranty personnel) upon removing replaceable printing component 12 from printing device 10. For example, to assist in detecting fraudulent warranty submissions, it may be useful to conceal an "Out Of Warranty" message to reduce the possibility that the message is altered or removed. In such implementations, after message(s) 53,58 is formed on the imaging member (e.g., photoconductive drum 22), the imaging member is moved or rotated such that message(s) 53,58 is hidden from view. Thus, when replaceable printing component 12 is returned for warranty service, personnel evaluating a warranty claim can manually move or rotate the imaging member to a position where message(s) 53,58 is more easily viewed.

Although message(s) 53,58 is described as being formed as an image on photoconductor drum 22, a corresponding image of message(s) 53,58 is also formed on other imaging members of replaceable printing component 12, such as developer roller 24. Thus, presence of the corresponding image on developer roller 24 of message(s) 53,58 may be used solely or in addition to the image formed on photoconductor drum 22 to determine the status of replaceable printing component 12.

By forming a message on an imaging member of the replaceable printing component at the end of every print job (e.g., "In Warranty" or similar code to indicate that the cartridge is in warranty, "1", for example), the absence of such a message indicates that the replaceable printing component is not under warranty, or at least should receive more scrutiny in the warranty replacement process. Forming a message on an imaging member of the replaceable printing component at the end of every print job, therefore, should act as a deterrent to a customer who is falsely or fraudulently attempting to have an out-of-warranty replaceable printing component replaced under warranty.

In addition, by providing the specific reason (i.e., secondary message) as to why the replaceable printing component is not in warranty (e.g., "Out Of Warranty-Refill"), the manufacturer, retailer, or service center has the ability to explain to the customer specifically why the replaceable printing component is not in warranty. In addition, the manufacturer, retailer, or service center has the ability to keep from replacing components under warranty when the components are actually no longer under warranty (e.g., use outside specified operating conditions, remanufactured, refilled). Furthermore, by forming the message in a an imageable area not accessible by the application (or user) and/or forming the message as an unique marking (e.g., special character, logo, code), a customer is prevented from falsely or fraudulently creating the message on their own.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A replaceable printing component for a printing device, comprising:

an imaging member for transferring images of a print job to a media; and means for forming a message on the imaging member in response to a trigger event, wherein the trigger event comprises an end of the print job, wherein the message remains on the imaging member after completion of the print job.

2. A method for providing a message on a replaceable printing component of a printing device, the method comprising:

detecting a trigger event;

retrieving a message from a memory associated with the replaceable printing component in response to the trigger event; and forming the message on an imaging member of the replaceable printing component, wherein the trigger event comprises an end of a print job, and wherein the message remains on the imaging member after completion of the print job.

3. The method of claim 2, wherein the memory comprises one of an integrated component memory of the replaceable printing component or a memory of the printing device.

4. The method of claim 2, wherein the trigger event further comprises one of an operational life status or a warranty status of the replaceable printing component.

5. The method of claim 2, wherein the trigger event further comprises replacement of the replaceable printing component in the printing device, and wherein the message comprises a first message if a manufacturer of the replaceable printing component is associated with a manufacturer of the printing device, and comprises a second message if the manufacturer of the replaceable printing component is not associated with the manufacturer of the printing device.

6. The method of claim 2, wherein the message comprises a primary message and a secondary message associated with the primary message, wherein the primary message includes a status of the replaceable printing component, and the secondary message includes a reason for the status.

7. The method of claim 2, wherein the imaging member of the replaceable printing component includes an application accessible imageable area, and wherein forming the message on the imaging member includes forming the message outside the application accessible imageable area.

8. The method of claim 2, wherein the message is not visible to a user upon removable of the replaceable printing component from the printing device.

9. A replaceable printing component for a printing device, comprising:

an imaging member; and a memory associated with the replaceable printing component, wherein, in response to a trigger event, a message is retrieved from the memory and formed on the imaging member, wherein the trigger event comprises an end of a print job, and wherein the message remains on the imaging member after completion of the print job.

10. The replaceable printing component of claim 9, wherein the memory comprises one of an integrated component memory of the replaceable printing component or a memory of the printing device.

11. The replaceable printing component of claim 9, wherein the trigger event further comprises one of an operational life status or a warranty status of the replaceable printing component.

12. The replaceable printing component of claim 9, wherein the trigger event further comprises replacement of the replaceable printing component in the printing device, and wherein the message comprises a first message if a manufacturer of the replaceable printing component is associated with a manufacturer of the printing device, and comprises a second message if the manufacturer of the replaceable printing component is not associated with the manufacturer of the printing device.

13. The replaceable printing component of claim 9, wherein the message comprises a primary message and a secondary message associated with the primary message, wherein the primary message includes a status of the replaceable printing component, and the secondary message includes a reason for the status.

14. The replaceable printing component of claim 9, wherein the imaging member includes an application accessible imageable area, and wherein the message is formed outside the application accessible imageable area.

15. The replaceable printing component of claim 9, wherein the message is not visible to a user upon removal of the replaceable printing component from the printing device.

* * * * *